US007802512B2

(12) United States Patent
Lee et al.

(10) Patent No.: US 7,802,512 B2
(45) Date of Patent: Sep. 28, 2010

(54) ASSEMBLY STRUCTURE OF DRIVE SHAFT AND SWASH PLATE IN SWASH PLATE TYPE COMPRESSOR

(75) Inventors: Geonho Lee, Anseing-shi (KR); Haksoo Kim, Anseing-shi (KR); Kibeom Kim, Sacheon-shi (KR); Ikseo Park, Asan-shi (KR); Kijung An, Asan-shi (KR)

(73) Assignees: DOOWON Technical College (KR); DOOWON Electronic Co., Ltd. (KR)

( * ) Notice: Subject to any disclaimer, the term of this patent is extended or adjusted under 35 U.S.C. 154(b) by 359 days.

(21) Appl. No.: 12/069,009

(22) Filed: Feb. 6, 2008

(65) Prior Publication Data

US 2008/0223208 A1 Sep. 18, 2008

(30) Foreign Application Priority Data

| | | |
|---|---|---|
| Feb. 7, 2007 | (KR) | 10-2007-0012562 |
| Feb. 7, 2007 | (KR) | 10-2007-0012568 |
| Mar. 6, 2007 | (KR) | 10-2007-0022104 |
| Jan. 15, 2008 | (KR) | 10-2008-0004228 |

(51) Int. Cl.
*F04B 27/08* (2006.01)
*F01B 3/02* (2006.01)

(52) U.S. Cl. ..... 92/12.2; 92/71

(58) Field of Classification Search ..... 92/12.2, 92/71; 417/222.2

See application file for complete search history.

(56) References Cited

U.S. PATENT DOCUMENTS

| | | | | |
|---|---|---|---|---|
| 6,164,252 | A * | 12/2000 | Kuhn et al. | 123/56.3 |
| 6,705,841 | B2 * | 3/2004 | Pawelski et al. | 417/222.1 |
| 6,928,919 | B2 * | 8/2005 | Parsch | 92/12.2 |
| 7,201,566 | B2 * | 4/2007 | Casar et al. | 417/269 |
| 7,444,921 | B2 * | 11/2008 | Theodore, Jr. | 92/12.2 |
| 7,490,540 | B2 * | 2/2009 | Schwarzkopf | 92/12.2 |
| 2006/0285981 | A1 * | 12/2006 | Theodore, Jr. | 417/269 |

FOREIGN PATENT DOCUMENTS

| | | |
|---|---|---|
| JP | 2005-146968 | 6/2005 |
| KR | 1020010039832 | 5/2001 |

* cited by examiner

*Primary Examiner*—Thomas E Lazo
(74) *Attorney, Agent, or Firm*—Ballard Spahr LLP

(57) ABSTRACT

Provided is an assembly structure of a drive shaft and a swash plate in a swash plate type compressor including a housing, a cylinder block having a plurality of cylinder bores, a drive shaft rotatably supported by the cylinder block or the housing, a swash plate installed at the drive shaft to vary its tilt angle with respect to the drive shaft, and pistons reciprocally accommodated in the cylinder bores, characterized in that the assembly structure includes: a swash plate tilt support pin fixedly installed at the drive shaft to cross the drive shaft; a hinge coupling groove formed in the swash plate to be rotatably coupled to a tip of the swash plate tilt support pin in a tilted manner, and a swash plate support part formed in the swash plate to support the drive shaft.

Therefore, it is possible to simplify the structure of the swash plate type compressor and reduce its own weight by omitting a lug plate or a hinge mechanism in an assembly structure of the drive shaft and the swash plate.

23 Claims, 13 Drawing Sheets

(a)

(b)

(a)

(b)

(a)

(b)

(a)

(b)

(a)

(b)

ASSEMBLY STRUCTURE OF DRIVE SHAFT AND SWASH PLATE IN SWASH PLATE TYPE COMPRESSOR

CROSS-REFERENCE TO RELATED APPLICATION

This application claims the benefit of Korean Patent Application No. 2007-12562, filed Feb. 7, 2007, No. 2007-12568, filed Feb. 7, 2007, No. 2007-22104, filed Mar. 6, 2007, and No. 2008-4228, filed Jan. 15, 2008, the disclosure of which is hereby incorporated herein by reference in its entirety.

BACKGROUND OF THE INVENTION

1. Field of the Invention

The present invention relates to an assembly structure of a drive shaft and a swash plate in a swash plate type compressor, and more particularly, to an assembly structure of a drive shaft and a swash plate in a swash plate type compressor capable of simplifying structure and reducing weight thereof by providing a pin-shaped assembly structure.

2. Description of the Prior Art

A general swash plate type compressor is widely used as a compressor of an air conditioner for a vehicle. In such a swash plate type compressor, a disc-shaped swash plate having a certain tilt angle is fixedly installed at a drive shaft for receiving power from an engine to be rotated by the drive shaft. Rotation of the swash plate reciprocates a plurality of pistons inserted into a plurality of cylinder bores formed in a cylinder block through the medium of shoes formed along a periphery of the swash plate, thereby sucking, compressing and discharging a coolant gas.

In particular, in recent times, a variable displacement swash plate type compressor has been developed. Here, a tilt angle of the swash plate is varied depending on a thermal load to control strokes of pistons to accomplish precise temperature control. At the same time, the tilt angle is continuously varied to reduce abrupt torque fluctuation of an engine caused by the compressor, thereby improving ride comfort of a vehicle.

An example of a typical variable displacement swash plate type compressor is disclosed in Korean Patent Registration No. 0386912 (hereinafter, referred to as "conventional art"), and the structure is shown in FIG. 1.

As shown, the conventional variable displacement swash plate type compressor includes a cylinder block 12 having a plurality of cylinder bores 12*a* parallelly formed in a longitudinal direction of an inner periphery thereof, a front housing 11 hermetically coupled to a front part of the cylinder block 12, and a rear housing 13 hermetically coupled to a rear part of the cylinder block 12 with a valve plate 14 interposed therebetween.

A swash plate chamber 15 is provided inside the front housing 11, and a drive shaft 16 is disposed to pass through the swash plate chamber 15. For this purpose, one end of the drive shaft 16 is rotatably supported at a center of the front housing 11 via a bearing, and the other end of the drive shaft 16 is rotatably supported in a center shaft hole of the cylinder block 12.

In addition, a swash plate 18 is installed at the drive shaft 16 to move along a hinge mechanism of a lug plate 17 and vary a tilt angle thereof.

Further, the rear housing 13 includes a discharge chamber 27 and a suction chamber 28, and the valve plate 14 interposed between the rear housing 13 and the cylinder block 12 has a discharge port 29 and a suction port 31 corresponding to each cylinder bore 12*a*.

A suction valve 30 and a discharge valve 32 are installed at the suction port 31 and the discharge port 29 formed in the valve plate 14 to open and close the suction port 31 and the discharge port 29 using pressure variation according to reciprocation of the piston 20.

Meanwhile, the piston 20 includes a piston head 22 reciprocating along the cylinder bore 12*a*, and a piston neck 23 through which the swash plate 18 passes. In addition, a seat is formed at the neck 23 to accommodate a shoe 21 such that the swash plate 18 passes through the shoe 21.

According to the above constitution, rotation of the drive shaft 16 rotates the lug plate 17 and the swash plate 18, and the tilted swash plate 18 is rotated beyond the shoe 21 to straightly reciprocate the piston 20 along the cylinder bore 12*a*.

However, since an assembly structure of a drive shaft and a swash plate of the conventional swash plate type compressor employs the lug plate 17 and a hinge structure 19 in order to transmit power between the drive shaft 16 and the swash plate 18 and prevent loosening therebetween, the assembly structure and the internal structure of the compressor are complicated and heavyweight.

SUMMARY OF THE INVENTION

An object of the present invention is to provide an assembly structure of a drive shaft and a swash plate of a swash plate type compressor capable of simplifying structure to readily manufacture the compressor and reduce its weight.

An aspect of the invention provides an assembly structure of a drive shaft and a swash plate in a swash plate type compressor including a housing, a cylinder block having a plurality of cylinder bores, a drive shaft rotatably supported by the cylinder block or the housing, a swash plate installed at the drive shaft to vary its tilt angle with respect to the drive shaft, and pistons reciprocally accommodated in the cylinder bores, characterized in that the assembly structure includes: a swash plate tilt support pin fixedly installed at the drive shaft to cross the drive shaft; a hinge coupling groove formed in the swash plate to be rotatably coupled to a tip of the swash plate tilt support pin in a tilted manner, and a swash plate support means formed in the swash plate to support the drive shaft.

Here, the swash plate may have a through-hole larger than an outer diameter of the drive shaft, a swash plate idling prevention pin may be fixedly installed at an inner periphery of the swash plate opposite to the hinge coupling groove to extend in a radial inward direction to constitute the swash plate support means, and a movement guide groove may be formed in an outer periphery of the drive shaft to guide axial movement of an end of the swash plate idling prevention pin.

In this case, the hinge coupling groove may be a partially conical groove that narrows toward an outer periphery of the swash plate.

In addition, the hinge coupling groove may have a partially conical shape that narrows toward an outer periphery of the swash plate, and a partially spherical end part.

Further, the swash plate idling prevention pin may include a cylindrical rod, and a drive shaft contact part having a partially spherical shape and formed at an inner end thereof.

Furthermore, the width of an outer end of the swash plate idling prevention pin may be larger than an outer diameter of the rod, and a coupling groove may be formed in an outer periphery of the swash plate to closely accommodate the outer end.

In addition, the outer periphery of the swash plate having the outer end coupled to the swash plate idling prevention pin may be exposed to the exterior.

Further, the swash plate idling prevention pin may be coupled to the swash plate by press-fitting or bolt-fixing at its tip part.

Meanwhile, the swash plate may have a through-hole larger than an outer diameter of the drive shaft, a guide rod may be fixedly installed to the swash plate to cross the through-hole, the drive shaft has a guide hole through which the guide rod moves, and a spring as the swash plate support means may be installed at the guide rod to be disposed between the drive shaft and the swash plate.

In this case, the guide hole may be vertically formed at a projection extending from a side surface of the drive shaft.

In addition, two projections, two guide holes, and two guide rods may be respectively formed about the drive shaft in an opposite manner.

Further, the swash plate tilt support pin may include a rod disposed in a radial direction thereof, and a cylindrical contact part formed to cross an end of the rod.

Furthermore, the rod may have a shape that narrows away from the drive shaft.

In addition, a movable washer may be interposed between the swash plate support means and the projection.

Further, the swash plate support means may be a coil spring or a disc spring.

Furthermore, the hinge coupling groove may have an opening formed in the outer periphery of the swash plate, and a cap may be installed at the opening.

In addition, the swash plate may include an inner swash plate in which the through-hole and a guide rod are disposed, and an outer swash plate having a hinge coupling groove and coupled around the inner swash plate.

Meanwhile, a stopper may project from a side surface of the drive shaft to limit rotation of the swash plate.

In this case, the swash plate tilt support pin may include a rod disposed in a radial direction thereof, and a cylindrical contact part formed to cross an end of the rod.

In addition, the rod may be detachably coupled to the contact part.

Further, the rod may have a shape that narrows away from the drive shaft.

Furthermore, the hinge coupling groove may be opened at the outer periphery of the swash plate to form an opening, and a cap may be installed at the opening.

In addition, the stoppers may be formed at both surfaces of the drive shaft in an opposite manner.

Further, a contact surface of a swash plate contact part of the stopper may be in contact with a front surface of the swash plate upon a maximum tilt angle of the swash plate.

Furthermore, the swash plate support means may be a threshold projecting from an inner surface of the hinge coupling groove such that at least one end of the contact part in a circumferential direction of the swash plate is hooked.

In addition, the hinge coupling groove may have a partially conical groove that narrows toward an outer periphery of the swash plate.

BRIEF DESCRIPTION OF THE DRAWINGS

The above and other objects, features and advantages of the present invention will be more apparent from the following detailed description taken in conjunction with the accompanying drawings, in which.

DETAILED DESCRIPTION OF EXEMPLARY EMBODIMENTS

Hereinafter, exemplary embodiments of the present invention will be described with reference to the accompanying drawings.

Embodiment 1

FIGS. 2 to 7 show the constitution of a swash plate type compressor including an assembly structure of a drive shaft and a swash plate in accordance with an exemplary embodiment of the present invention.

Figure 7:
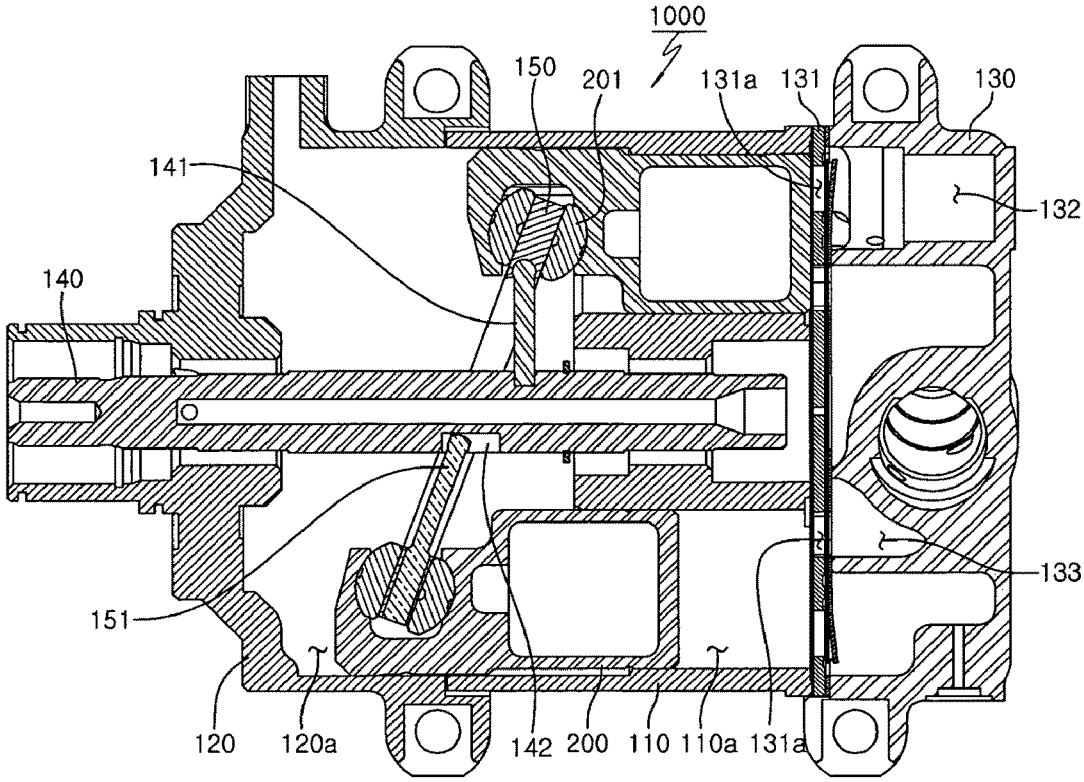
FIG. 7 is a longitudinal cross-sectional view of a swash plate type compressor including an assembly structure of a drive shaft and a swash plate in accordance with a first exemplary embodiment of the present invention.
Figure 8:
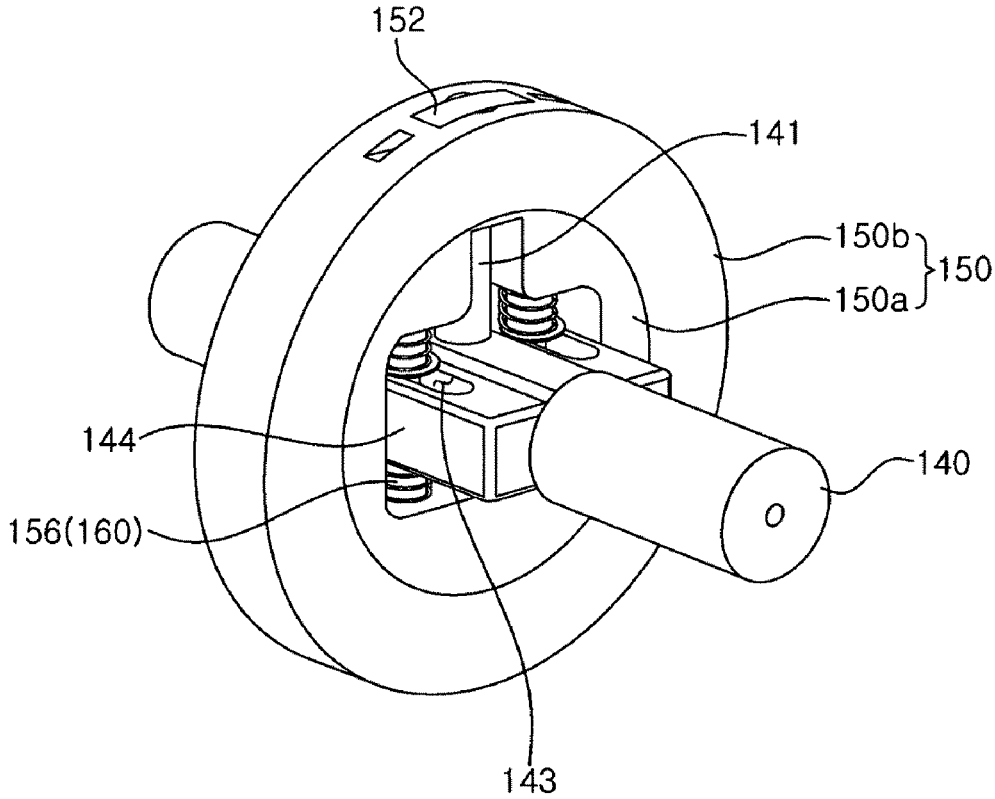
FIG. 8 is a perspective view of an assembly structure of a drive shaft and a swash plate of a swash plate type compressor in accordance with a second exemplary embodiment of the present invention.

As shown in FIG. 7, a swash plate type 1000 in accordance with an exemplary embodiment of the present invention includes a cylinder block 110 having a plurality of cylinder bores 110*a* parallelly formed in a longitudinal direction of an inner periphery thereof to configure an appearance of the compressor, a front housing 120 disposed at a front end of the cylinder block 110 to form a swash plate chamber 120*a*, a drive shaft 140 rotatably supported by the cylinder block 110 and the front housing 120, a rear housing 130 having a discharge chamber 132 and a suction chamber 133 and disposed at a rear end of the cylinder block 110, a swash plate 150 having a disc shape and rotatably movable with respect to the cylinder block 110 and the housing to vary a tilt angle thereof, and pistons 200 slidably coupled to the swash plate 150 via shoes 201 and reciprocally accommodated in the cylinder bores 110.

A valve plate 131 is disposed between the cylinder block 110 and the rear block 130, and has a discharge port 131*a* for communicating the cylinder bore 110*a* with the discharge chamber 132, and a suction port 131*b* for communicating the cylinder bore 110*a* with the suction chamber 133.

In addition, a discharge valve and a suction valve are installed at the discharge port 131*a* and the suction port 131*b* formed in the valve plate 131 to open and close the discharge port 131*a* and the suction port 131*b* using pressure variation according to reciprocal movement of the piston 200.

Since other constitutions are the same as the above-mentioned conventional art, descriptions there of will not be repeated.

Meanwhile, in accordance with the embodiment of the present invention, the swash plate 150 has a through-hole 155 relatively larger than an outer diameter of the drive shaft 140 such that the swash plate 150 can be freely moved around the drive shaft 140 in a tilted manner.

In addition, a swash plate tilt support pin 141 is fixedly installed at the drive shaft 140 to extend in a radial outward direction. That is, the swash plate tilt support pin 141 projects from an outer surface of the drive shaft 140 in a radial direction.

Further, a binge coupling groove 153 is formed in an inner periphery of the swash plate 150 to accommodate the swash plate tilt support pin 141 in a tilted manner.

In this case, the swash plate tilt support pin 141 has a cylindrical rod 141*a* and a spherical contact part 141*b* formed at a tip of the rod 141*a*, and the hinge coupling groove 153 has a partial cone shape which narrows toward an outer periphery of the swash plate 150 and has a spherical end. However, the contact part 141*b* of the swash plate tilt support pin 141 may have another appropriate shape, in addition to the spherical shape.

Therefore, the tip of the swash plate tilt support pin 141 as a ball joint may be coupled to the end of the hinge coupling groove 153. That is, the swash plate 150 and the drive shaft 140 are freely rotated with respect to a contact point between the swash plate tilt support pin 141 and the hinge coupling groove.

The rod 141*b* of the swash plate tilt support pin 141 may be a cylindrical shape or other elongated members having an arbitrary cross-section such as a polygonal shape, and so on.

Meanwhile, a swash plate idling prevention pin 151 is fixedly installed at an inner periphery of the swash plate 150 opposite to the hinge coupling groove 153 to extend in a radial inward direction. That is, the swash plate idling prevention pin 151 is configured to project inward through the through-hole 155 of the swash plate 150. For this purpose, a coupling hole 158 is formed at the swash plate 150 to pass from the outer periphery to the inner periphery thereof.

In addition, a movement guide groove 142 is formed in an outer periphery of the drive shaft 140 to guide axial movement of an end of the swash plate idling prevention pin 151. Rotational power of the drive shaft 140 is transmitted by hooking the swash plate idling prevention pin 151 into the movement guide groove 142.

In this case, in order to smoothly move the end of the swash plate idling prevention pin 151 in an axial direction, the swash plate idling prevention pin 151 includes a cylindrical rod 151*a*, and a drive shaft contact part 151*b* formed at an inner end of the pin 151 and having a partial spherical shape. The partial spherical shape may be configured to cover a minimum tilt angle and a maximum tilt angle of the swash plate 150. This is because corner parts of the partial spherical shape may be partially worn when a spherical shape range is small.

The rod 151*a* of the swash plate idling prevention pin 151 may be a cylindrical shape or other elongated members having an arbitrary cross-section such as a polygonal shape, and so on.

In addition, a width of an outer end 151*c* of the swash plate idling prevention pin 151 is larger than an outer diameter of the rod 151*a*, and a coupling groove 156 is formed in an outer periphery of the swash plate 150 to closely accommodate the outer end 151*c* of the swash plate idling prevention pin 151 to prevent the swash plate idling prevention pin 151 from being separated from the swash plate 150 inward to the drive shaft 140.

In this case, the swash plate idling prevention pin 151 can be coupled from the outer periphery of the swash plate 150 to a radial inner part thereof such that the outer end 151*c* is exposed to the outer periphery of the swash plate 150.

Further, the swash plate idling prevention pin 151 is coupled to the swash plate 150 through press-fitting or by fixing bolts at the end of the pin 151. As shown, a bolt is fixed around the drive shaft contact part 151*b* of the pin.

Figure 1:
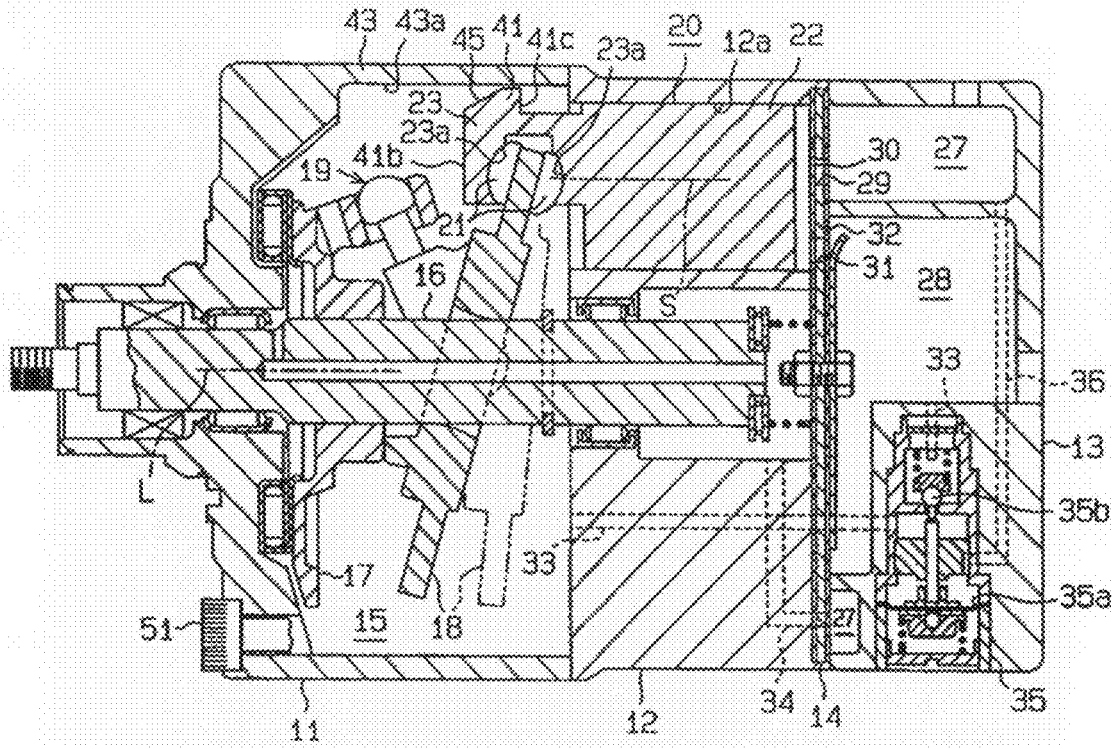
FIG. 1 is a longitudinal cross-sectional view of a conventional variable displacement swash plate type compressor including a rotation prevention structure.
Figure 2:
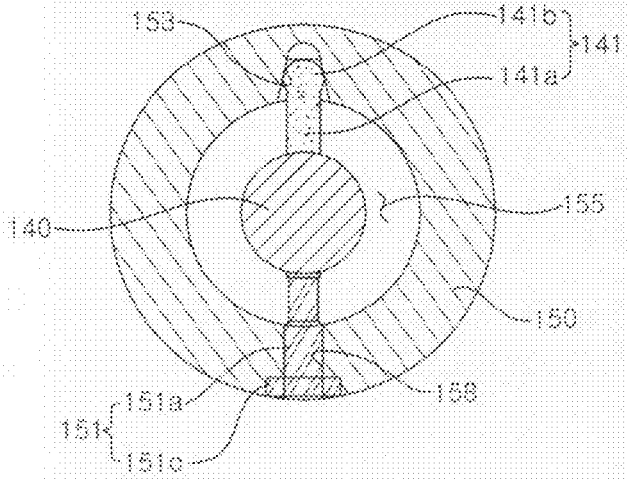
FIG. 2 is a front cross-sectional view showing an assembly structure of a drive shaft and a swash plate of a swash plate type compressor in accordance with a first exemplary embodiment of the present invention.
Figure 3:
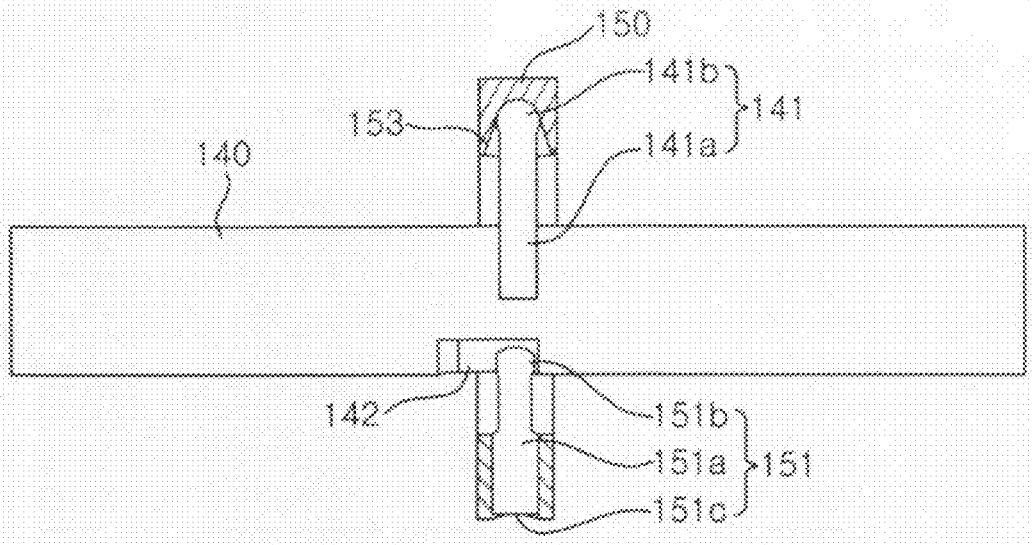
FIG. 3 is a side cross-sectional view showing an assembly structure of a drive shaft and a swash plate of a swash plate type compressor in accordance with a first exemplary embodiment of the present invention, (a) of which shows the structure upon a minimum tilt angle of the swash plate, and (b) of which shows the structure upon a maximum tilt angle of the swash plate.
Figure 3:
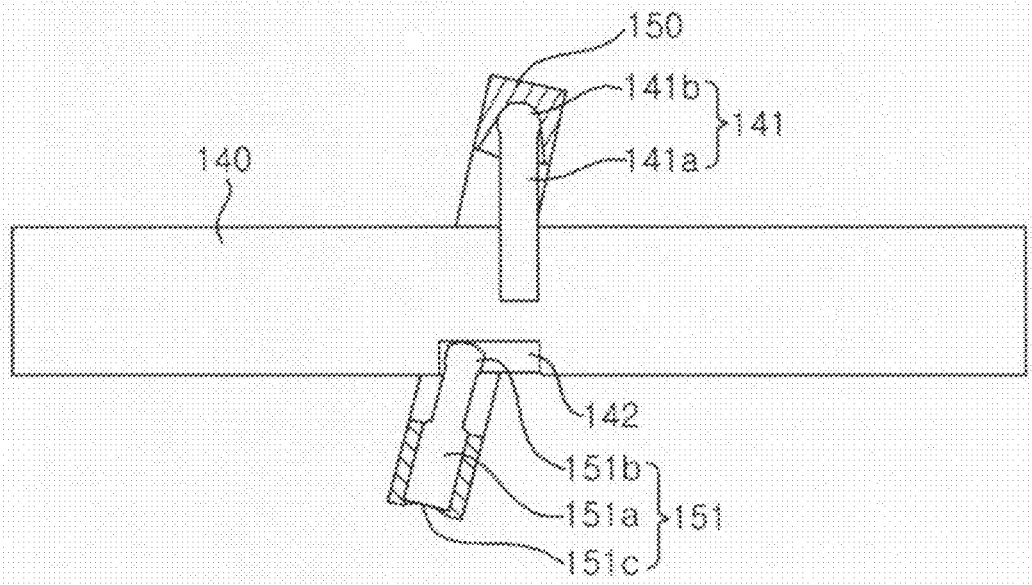
Figure 4:
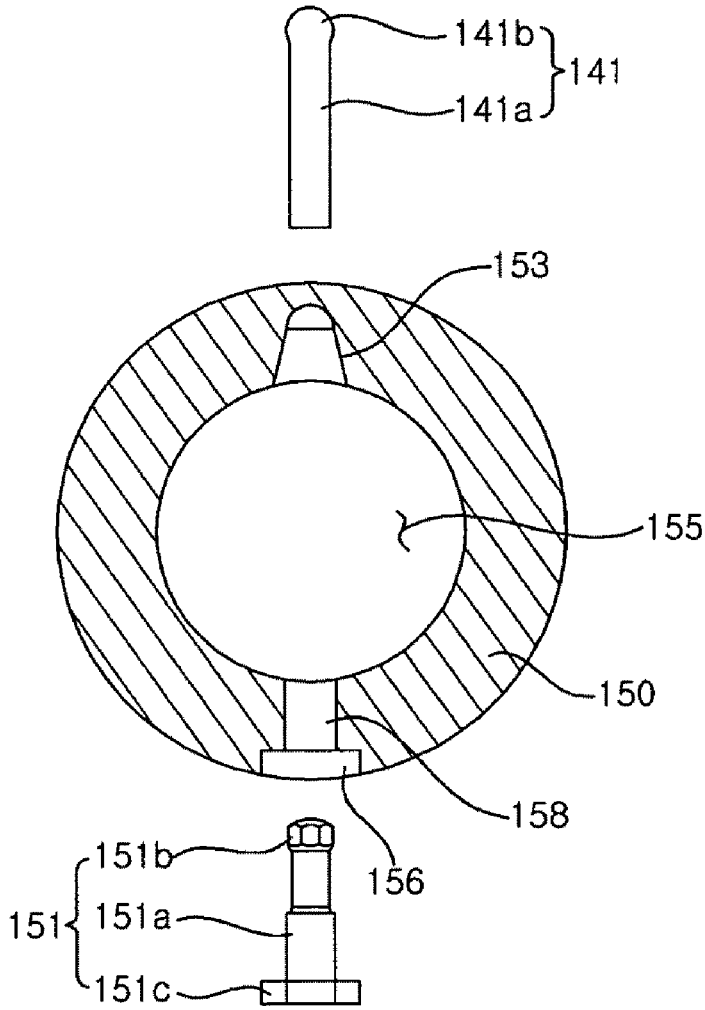
FIG. 4 is an exploded perspective view of the assembly structure of FIG. 2.
Figure 4:
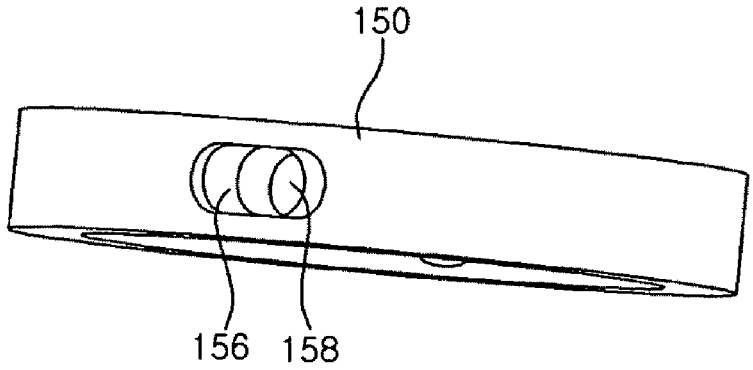
Figure 5A:
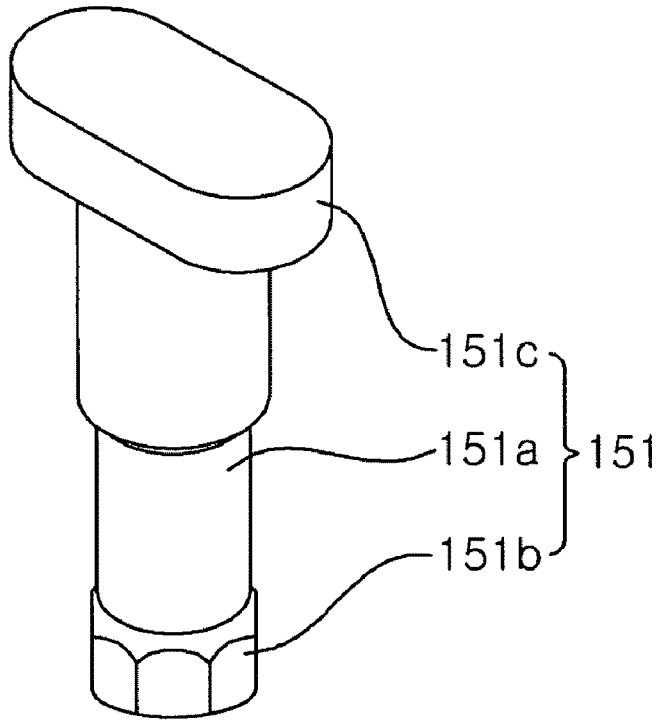
FIG. 5A is a perspective view showing a structure of a swash plate idling prevention pin of FIG. 2.
Figure 5B:
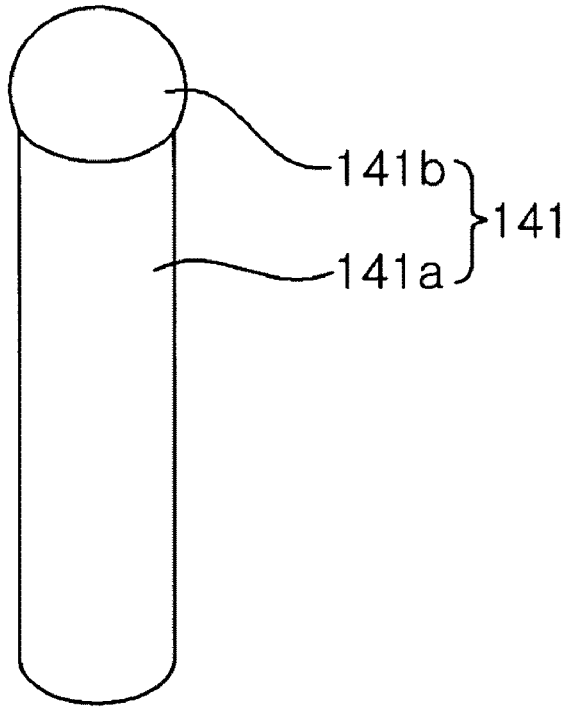
FIG. 5B is a perspective view showing a structure of a swash plate tilt support pin of FIG. 2.
Figure 6:
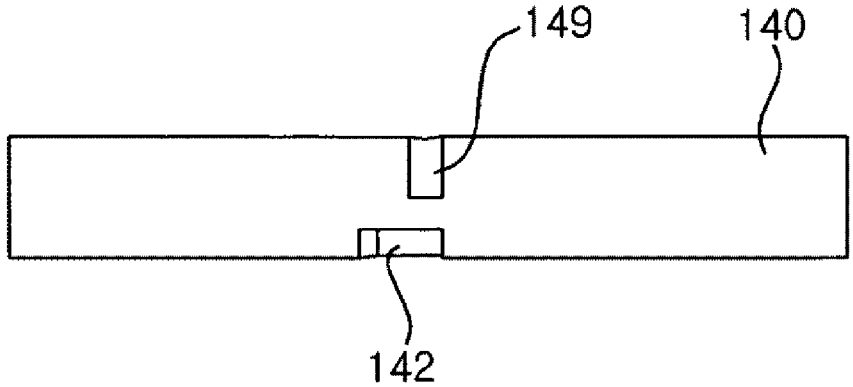
FIG. 6 is a view of a shaft part of FIG. 3, (a) of which is a side cross-sectional view, and (b) of which is a bottom perspective view.
Figure 6:
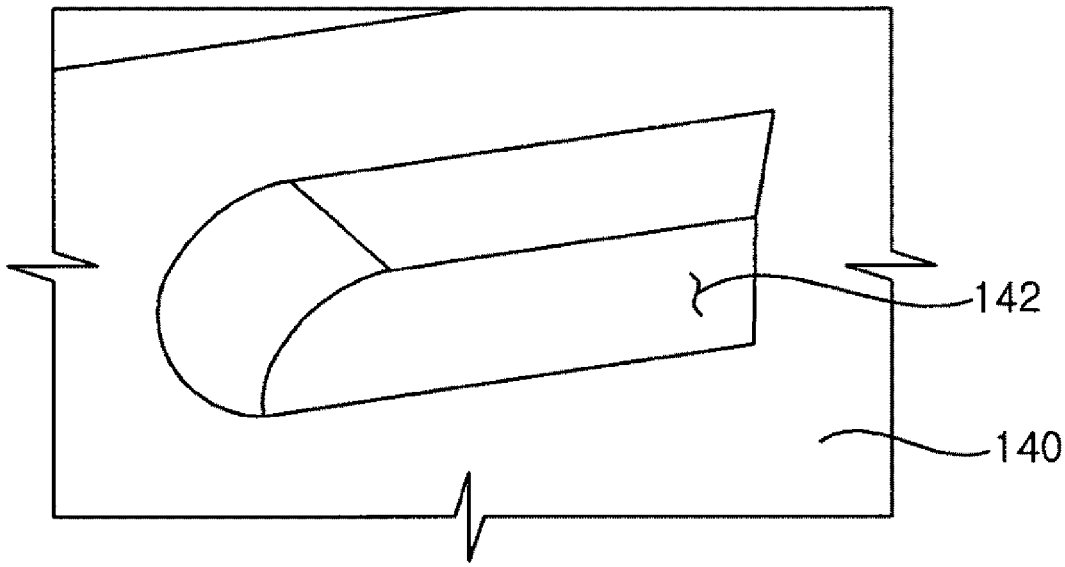

Accordingly, as shown in FIG. 3, the swash plate 150 in accordance with the present invention can be coupled to the drive shaft 140, without a lug plate and a hinge mechanism according to the conventional art.

That is, the swash plate 150 can be moved with respect to the swash plate tilt support pin 141 coupled to the drive shaft 140 through the hinge coupling groove 151 in a tilted manner.

Since the swash plate idling prevention pin 151 is moved along the movement guide groove 142 elongated in an axial direction of the drive shaft 140 opposite to the swash plate tilt support pin 141 during tilted movement, it is possible to transmit rotational power and prevent the swash plate 150 from being loosened or idled.

Therefore, both longitudinal ends of the movement guide groove 142 formed at the drive shaft 140 function as a stopper for maintaining minimum and maximum angles of the swash plate.

Reference numeral 149 designates a pin groove at which the swash plate tilt support pin 141 is coupled to the drive shaft 140.

Embodiment 2

FIGS. 8 to 11 show the constitution of a swash plate type compressor including an assembly structure of a drive shaft and a swash plate in accordance with an exemplary embodiment of the present invention. Description of elements the same as Embodiment 1 will not be repeated and important parts only will be described.

In accordance with an exemplary embodiment of the present invention, a through-hole 155 relatively larger than an outer diameter of the drive shaft 140 is formed in the swash plate 150 such that the swash plate 150 can be freely moved around the drive shaft 140 in a tilted direction, without any interference.

In addition, a swash plate tilt support pin 141 is fixedly installed at the drive shaft 140 to extend in a radial outward direction. That is, the swash plate tilt support pin 141 projects from an outer surface of the drive shaft 140 in a radial direction.

Further, a hinge coupling groove 151 is formed in the swash plate 150 to guide movement of the swash plate support pin 141 in a radial direction.

Figure 9A:
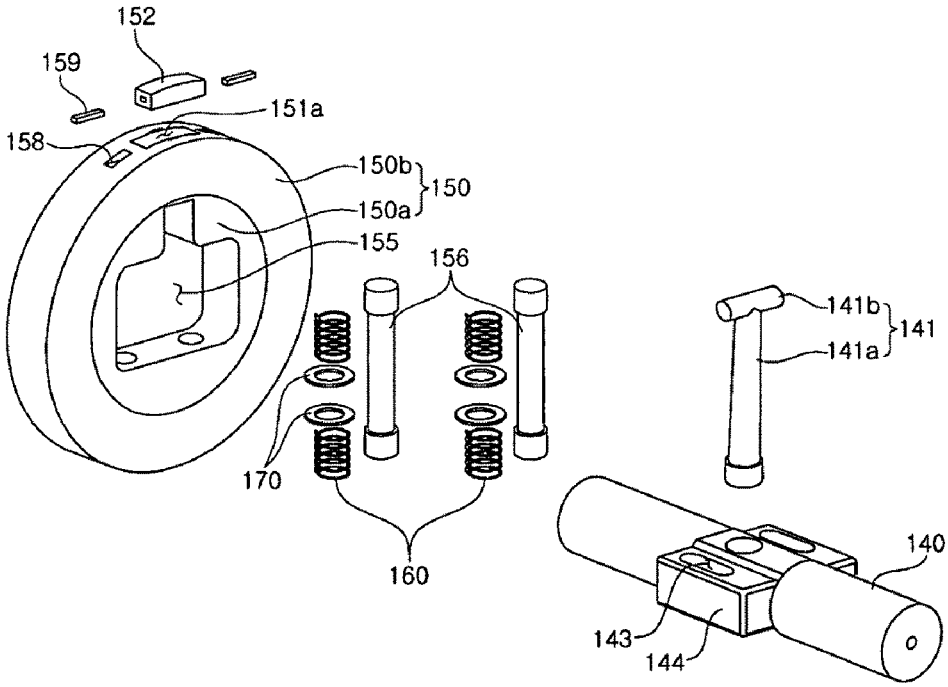
FIG. 9A is an exploded perspective view of the assembly structure of FIG. 8.

In FIG. 9, the hinge coupling groove 151 may be opened at an outer periphery of the swash plate 150 to form an opening 151*a*, but may be assembled in a closed state.

When the opening 151*a* exists, a cap 152 is installed to prevent the swash plate tilt support pin 141 from being exposed to the exterior of the swash plate 150. Moreover, the cap 152 functions to complement the weight such that the center of gravity of the swash plate 150 exists in the drive shaft, as well as prevents the swash plate tilt support pin 141 from projecting through the opening 151*a*.

As shown in FIG. 9, two coupling grooves 158 are formed in the swash plate 150 with the opening 151*a* interposed therebetween, and a coupling pin 159 is inserted into the coupling grooves 158 to fix the cap 152 to the hinge coupling groove 151.

As shown in FIG. 9, the swash plate tilt support pin 141 includes a rod 141*a* projecting in a radial direction when seen from the drive shaft, and a contact part 141*b* crossing an end of the rod 141*a* and having a cylindrical shape. The rod 141*a* and the contact part 141*b* may be integrally formed through welding and so on, or coupled to each other through press-fitting.

Therefore, the swash plate tilt support pin 141 is moved along the hinge coupling groove 151 of the swash plate 150, while the outer surface of the contact part 141*b* is in contact with the hinge coupling groove 151.

Since the rod 141*a* has a shape that gradually narrows away from the drive shaft 140, it is possible to readily insert the drive shaft 140 into the through-hole 155 and maximally prevent interference with the swash plate 150 during assembly.

Meanwhile, in order to transmit power from the drive shaft 140 to the swash plate 150, guide rods 156 are fixedly installed to the swash plate 150 to cross the through-hole 155 of the swash plate 150, and guide holes 143 through which the guide rods 156 pass to relatively move are formed in the drive shaft 140. The guide holes 143 have an elongated shape extending toward the drive shaft 140.

In particular, the guide holes 143 may be vertically formed in projections 144 extending from side surfaces of the drive shaft 140 to effectively use a space in the through-hole 155.

In addition, resilient means 160 are installed at the guide rods 156 to be interposed between the projections 144 of the drive shaft 140 and the swash plate 150. Contact parts between the projections 144 and the resilient means 160 of the swash plate 150 may be flattened such that the resilient means 160 are seated. Further, in the drawings, the resilient means 160 is formed of a coil spring, but may be formed of a disc spring.

Here, movable washers 170 are interposed between the resilient means 160 and the projections 144 such that the guide rods 156 can be readily moved through the guide holes 143.

As shown in FIGS. 8 to 11, two projections 144, two guide holes 143, and two guide rods 156 are respectively formed about the drive shaft 140 in an opposite manner.

Of course, while the projections 144, the guide hole 143 and the guide rod 156 may be solely installed, it may be difficult to align the center of gravity, and eccentricity during rotation may increase a probability of vibration.

Meanwhile, in the drawings, the swash plate 150 is divided into an inner swash plate 150*a* and an outer swash plate 150*b* installed to surround the inner swash plate 150*a*, which are coupled to each other. However, the swash plate 150 may be integrally formed as a single body.

Here, when the swash plate 150 is divided, the through-hole 155 may be formed in the inner swash plate 150*a* at which the guide rod 156 is installed, and the hinge coupling groove 151 may be formed in the outer swash plate 150*b*.

Figure 9B:
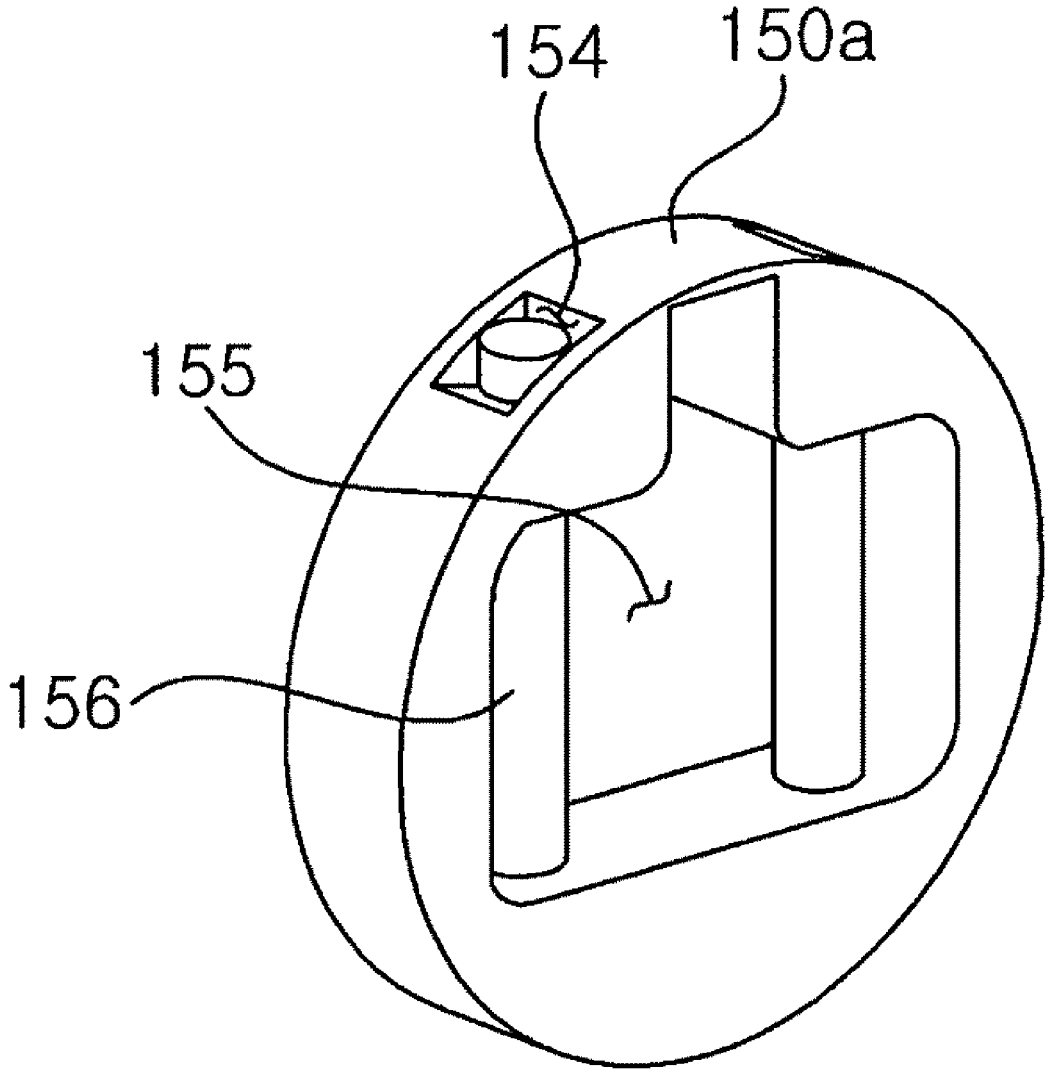
FIG. 9B is a perspective view showing an example of FIG. 8 in which an inner swash plate is coupled to a guide rod.
Figure 10:
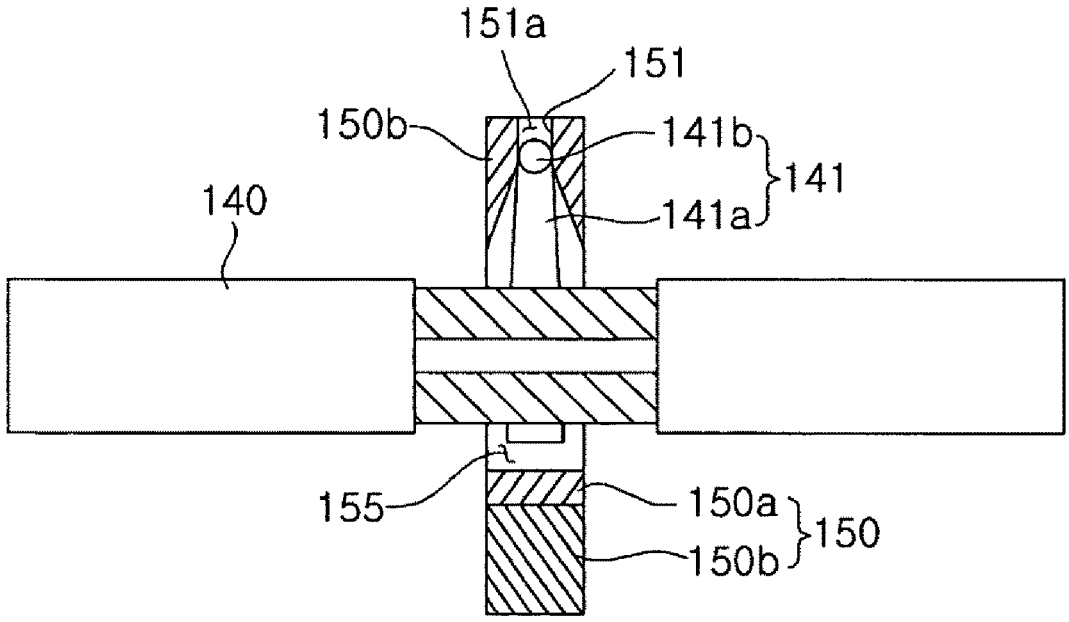
FIG. 10 is a side cross-sectional view of an assembly structure of a drive shaft and a swash plate of a swash plate type compressor in accordance with a second exemplary embodiment of the present invention, (a) of which shows the structure upon a minimum tilt angle of the swash plate, and (b) of which shows the structure upon a maximum tilt angle of the swash plate.
Figure 10:
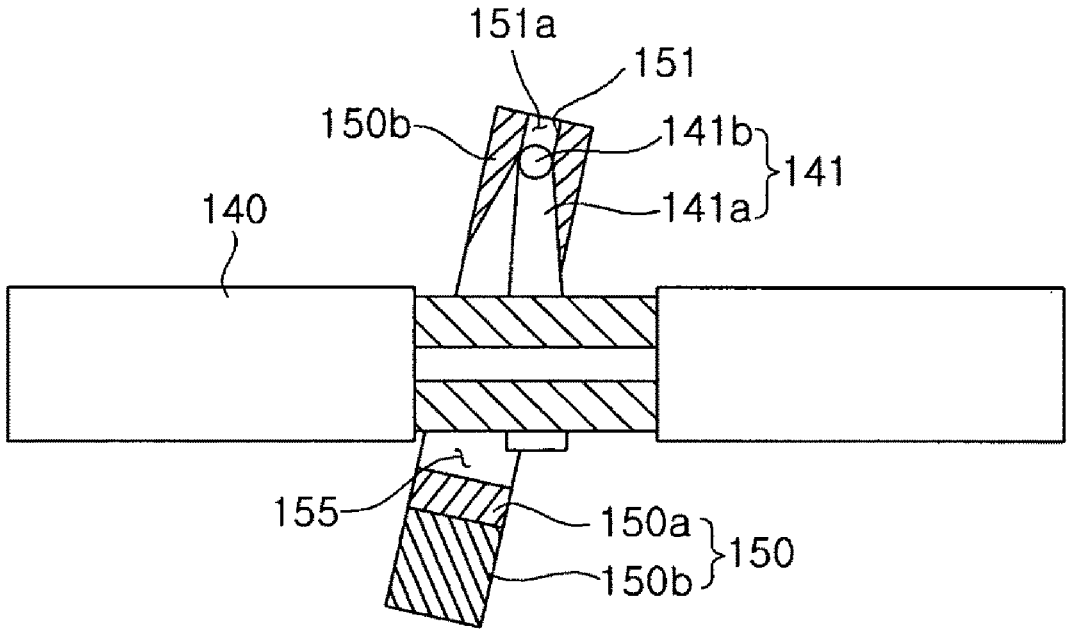

As shown in FIG. 9B, when the guide rod 156 is installed at the inner swash plate 150*a*, a groove 154 is formed at a periphery of the inner swash plate 150*a*, and a coupling hole is formed at the bottom of the groove 154 to securely fix the guide rod 156.

Figure 11:
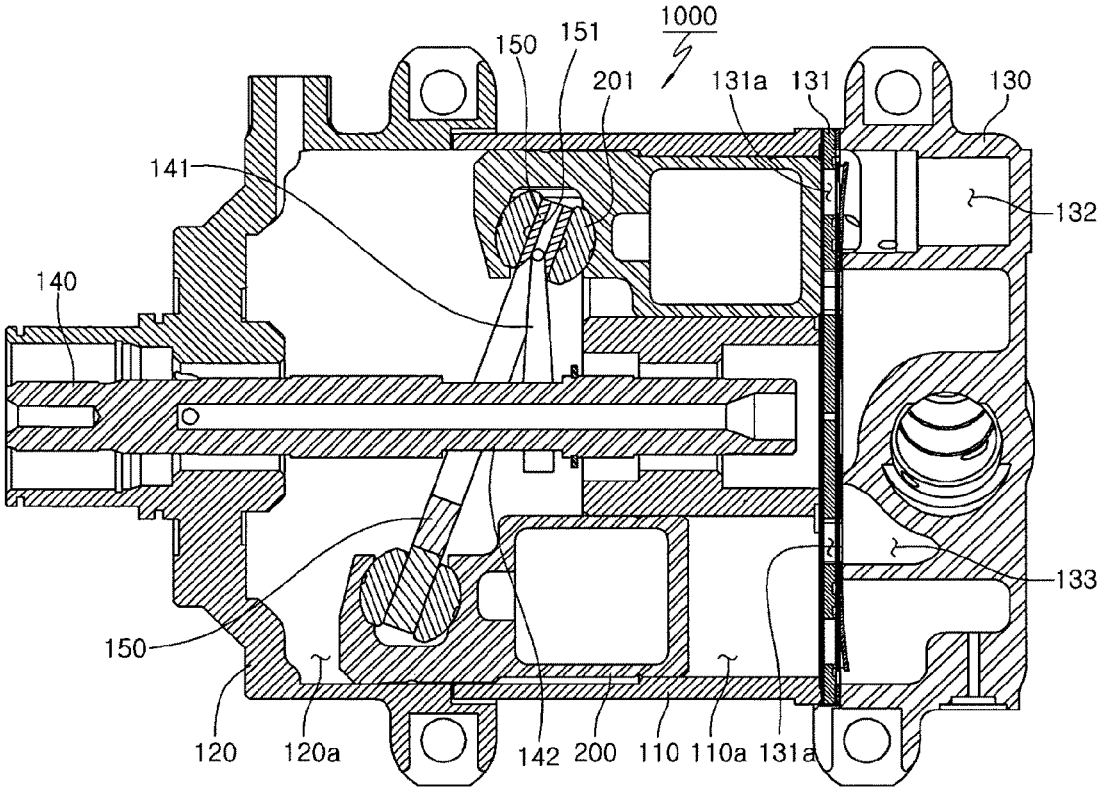
FIG. 11 is a longitudinal cross-sectional view of a swash plate type compressor including an assembly structure of a drive shaft and a swash plate in accordance with a second exemplary embodiment of the present invention.
Figure 12:
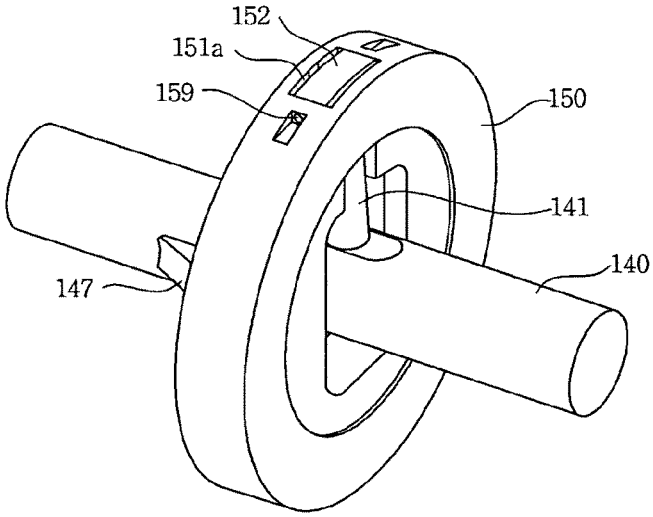
FIG. 12 is a perspective view of an assembly structure of a drive shaft and a swash plate of a swash plate type compressor in accordance with a third exemplary embodiment of the present invention.

Accordingly, as shown in FIG. 11, in accordance with the present invention, it is possible to couple the swash plate 150 to the drive shaft 140, without a lug plate and a hinge mechanism according to the conventional art.

That is, when the compressor 100 is operated, the swash plate 150 can be moved with respect to the swash plate tilt support pin 141 coupled to the drive shaft 140 through the hinge coupling groove 151 in a tilted manner.

Since the guide rod 156 is moved through the guide hole 143 formed in the projection 144 of the drive shaft 140 during the tilted movement, it is possible to transmit rotational power and prevent the swash plate 150 from being loosened or idled.

In this case, both longitudinal ends of the guide hole 143 formed in the projection 144 of the drive shaft 140 function as a stopper for maintaining minimum and maximum angle postures of the swash plate 150.

Embodiment 3

FIGS. 12 to 15 show the constitution of a swash plate type compressor including an assembly structure of a drive shaft and a swash plate in accordance with an exemplary embodiment of the present invention. Description of elements the same as Embodiment 2 will not be repeated, and important parts only will be described.

In accordance with an exemplary embodiment of the present invention, a through-hole 155 relatively larger than an outer diameter of the drive shaft 140 is formed in the swash plate 150 such that the swash plate 150 can be freely moved around the drive shaft 140 in a tilted direction, without any interference.

In addition, a swash plate tilt support pin 141 is fixedly installed at the drive shaft 140 to extend in a radial outward direction. That is, the swash plate tilt support pin 141 projects from an outer surface of the drive shaft 140 in a radial direction.

Further, a hinge coupling groove 151 is formed in the swash plate 150 to guide movement of the swash plate support pin 141 in a radial direction.

Figure 13:
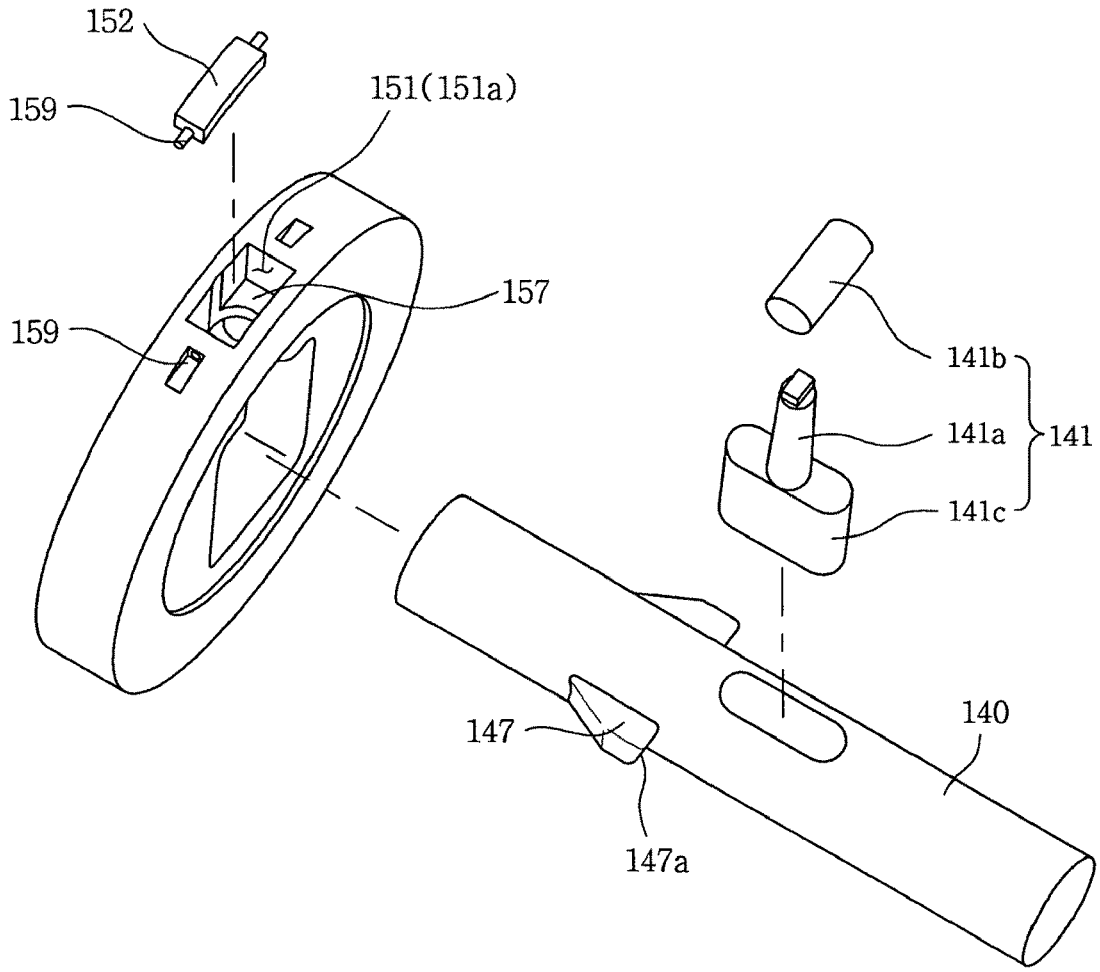
FIG. 13 is an exploded perspective view of the assembly structure of FIG. 12.

In FIG. 13, the hinge coupling groove 151 may be opened at an outer periphery of the swash plate 150 to form an opening 151*a*, but may be assembled in a closed state.

When the opening 151*a* exists, a cap 152 is installed to prevent the swash plate tilt support pin 141 from being exposed to the exterior of the swash plate 150. Moreover, the cap 152 functions to complement the weight such that the center of gravity of the swash plate 150 exists in the drive shaft, as well as prevents the swash plate tilt support pin 141 from projecting through the opening 151*a*.

As shown in FIG. 13, two coupling grooves 158 are formed in the swash plate 150 with the opening 151*a* interposed therebetween, and a coupling pin 159 is inserted into the coupling grooves 158 to fix the cap 152 to the hinge coupling groove 151.

As shown in FIG. 13, the swash plate tilt support pin 141 includes a rod 141*a* projecting in a radial direction when seen from the drive shaft, and a contact part 141*b* crossing an end of the rod 141*a* and having a cylindrical shape. Since the rod 141*a* and the contact part 141*b* may be coupled to each other through press-fitting, it is possible to readily assemble them by coupling the contact part 141*b* through the opening 151*a* after coupling the swash plate 150 to the rod 141*a* of the swash plate tilt support pin 141.

Therefore, the swash plate tilt support pin 141 is moved along the hinge coupling groove 151 of the swash plate 150, while the outer surface of the contact part 141*b* is in contact with the hinge coupling groove 151.

Thresholds 157 are formed at both ends of the hinge coupling groove 151 along a periphery of the swash plate 150 such that both ends of the contact part 141*b* are hooked by the thresholds 157. Therefore, it is possible to prevent the swash plate 150 from being separated from the contact part 141*b* of the swash plate tilt support pin 141 due to a centrifugal force of the swash plate 150 during rotation. The threshold 157 may be formed at only one end of the hinge coupling groove 151 to hook the contact part 141*b*.

Figure 14:
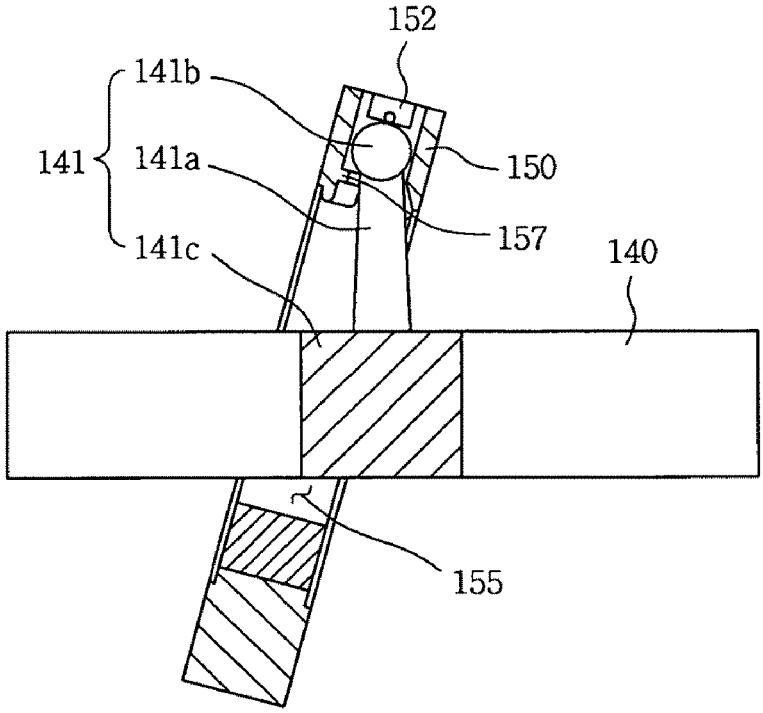
FIG. 14 is a side cross-sectional view of an assembly structure of a drive shaft and a swash plate of a swash plate type compressor in accordance with a third exemplary embodiment of the present invention, (a) of which shows the structure upon a minimum tilt angle of the swash plate, and (b) of which shows the structure upon a maximum tilt angle of the swash plate.
Figure 14:
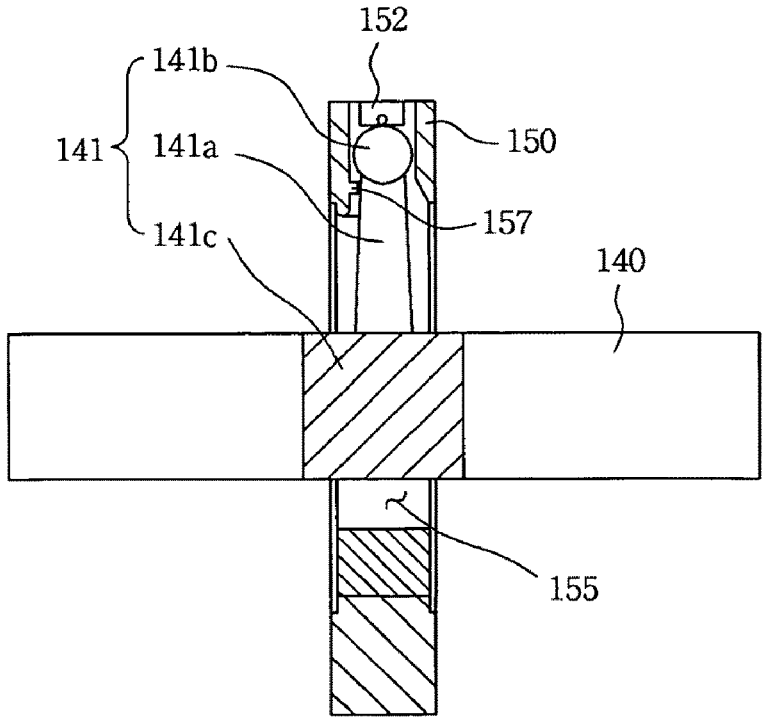

Accordingly, as shown in FIG. 14, the contact part 141*b* of the swash plate tilt support pin 141 is disposed between the cap 152 and the threshold 157 to be moved in the hinge coupling groove 151.

Actually, the swash plate tilt support pin 141 can reciprocate in the hinge coupling groove 151 through a movement path between the cap 152 and the threshold 157.

Since the rod 141*a* has a shape that narrows away from the drive shaft 140, it is possible to readily insert the drive shaft 140 into the through-hole 155 and maximally avoid interference during assembly of the swash plate 150.

In addition, since a coupling part 141*c* of the swash plate tilt support pin 141 coupled to the drive shaft 140 has the shape of an axially elongated post, it is possible to increase resistance against rotation moment.

Meanwhile, stoppers 147 projects from side surfaces of the drive shaft 140 to limit rotation of the swash plate 150. In particular, the stoppers 147 project from opposite surfaces of the drive shaft 140 to stably support the swash plate 150.

Further, when contact surfaces 147*a* of the swash plate contact part of the stopper 147 are in contact with a front surface of the swash plate 150 upon a maximum tilt angle of the swash plate 150, it is possible to widen a contact area and reduce a contact pressure to thereby reduce damage. In this case, the contact surface 147*a* of the stopper 147 may have an angle corresponding to the maximum tilt angle of the swash plate 150.

Figure 15:
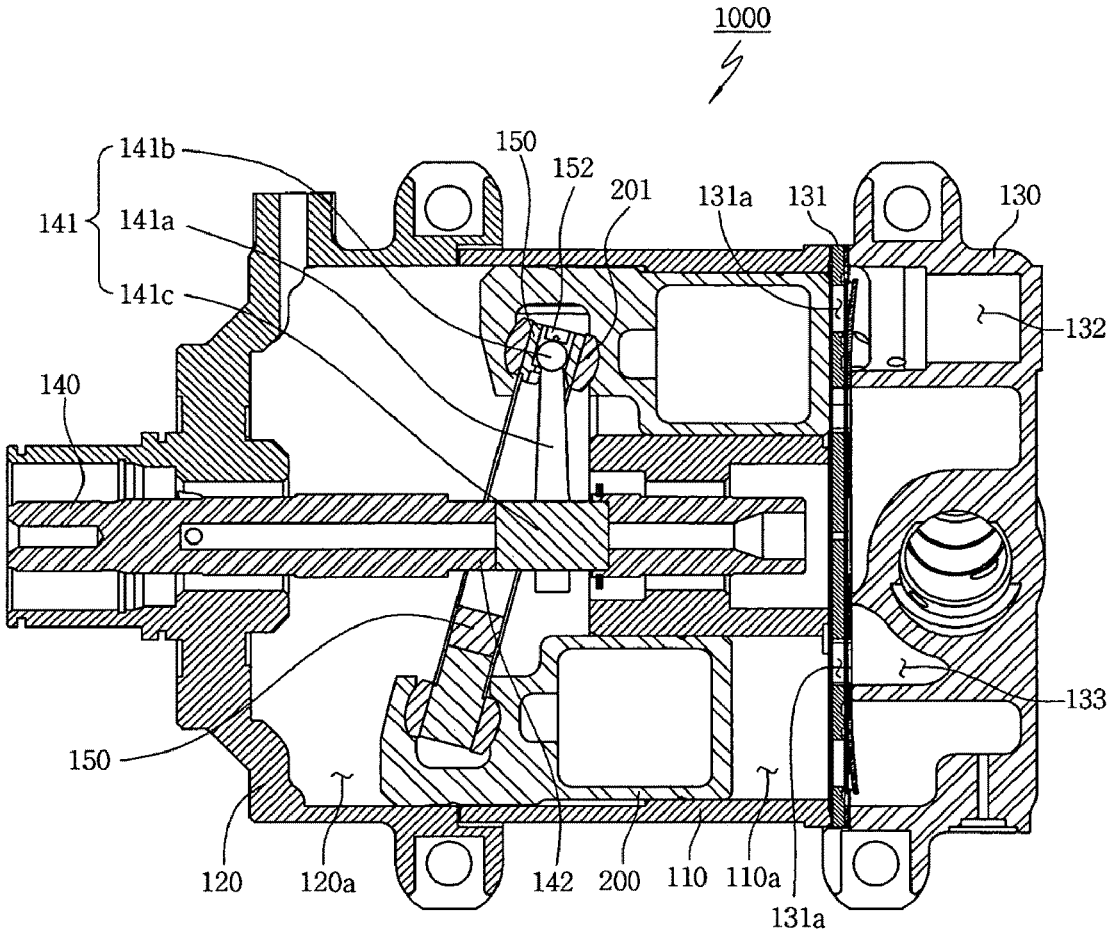
FIG. 15 is a longitudinal cross-sectional view of a swash plate type compressor including an assembly structure of a drive shaft and a swash plate in accordance with a third exemplary embodiment of the present invention.

Accordingly, as shown in FIG. 15, in accordance with the present invention, it is possible to couple the swash plate 150 to the drive shaft 140 without a lug plate and a hinge mechanism according to the conventional art.

That is, when the compressor 100 is operated, the swash plate 150 can be moved with respect to the swash plate tilt support pin 141 coupled to the drive shaft 140 through the hinge coupling groove 151 in a tilted manner.

In this case, it is possible to maintain the maximum tile angle of the swash plate 150 using the stoppers 147 formed at both surfaces of the drive shaft 140.

Constitutions of the above embodiments merely show examples of the present invention, and may be adapted to other swash plate type compressor including the swash plate and the drive shaft.

As can be seen from the foregoing, it is possible to simplify the structure of a swash plate type compressor and reduce its own weight by omitting a lug plate or a hinge mechanism in an assembly structure of the drive shaft and the swash plate.

In addition, it is possible to securely transmit power through the simple structure and prevent the swash plate from being loosened during operation of the compressor.

While this invention has been described with reference to exemplary embodiments thereof, it will be clear to those of ordinary skill in the art to which the invention pertains that various modifications may be made to the described embodiments without departing from the spirit and scope of the invention as defined in the appended claims and their equivalents.

What is claimed is:

1. An assembly structure of a drive shaft and a swash plate in a swash plate type compressor comprising a housing, a cylinder block having a plurality of cylinder bores, a drive shaft rotatably supported by the cylinder block or the housing, a swash plate installed at the drive shaft to vary its tilt angle with respect to the drive shaft, and pistons reciprocally accommodated in the cylinder bores, characterized in that the assembly structure comprises:

a swash plate tilt support pin fixedly installed at the drive shaft to cross the drive shaft;

a hinge coupling groove formed in the swash plate to be rotatably coupled to a tip of the swash plate tilt support pin in a tilted manner, and a swash plate support means formed in the swash plate to support the drive shaft, wherein the swash plate has a through-hole larger than an outer diameter of the drive shaft, a swash plate idling prevention pin is fixedly installed at an inner periphery of the swash plate opposite to the hinge coupling groove to extend in a radial inward direction to constitute the swash plate support means, and a movement guide groove is formed in an outer periphery of the drive shaft to guide axial movement of an end of the swash plate idling prevention pin.

2. The assembly structure according to claim 1, wherein the hinge coupling groove has a partially conical shape that narrows toward an outer periphery of the swash plate, and a partially spherical end part.

3. The assembly structure according to claim 1, wherein the swash plate idling prevention pin comprises a cylindrical rod, and a drive shaft contact part having a partially spherical shape and formed at an inner end thereof.

4. The assembly structure according to claim 3, wherein a width of an outer end of the swash plate idling prevention pin is larger than an outer diameter of the rod, and a coupling groove is formed in an outer periphery of the swash plate to closely accommodate the outer end.

5. The assembly structure according to claim 4, wherein the outer periphery of the swash plate having the outer end coupled to the swash plate idling prevention pin is exposed to the exterior.

6. The assembly structure according to claim 5, wherein the swash plate idling prevention pin is coupled to the swash plate by press-fitting or bolt-fixing at its tip part.

7. An assembly structure of a drive shaft and a swash plate in a swash plate type compressor comprising a housing, a cylinder block having a plurality of cylinder bores, a drive shaft rotatably supported by the cylinder block or the housing, a swash plate installed at the drive shaft to vary its tilt angle with respect to the drive shaft, and pistons reciprocally accommodated in the cylinder bores, characterized in that the assembly structure comprises:

a swash plate tilt support pin fixedly installed at the drive shaft to cross the drive shaft;

a hinge coupling groove formed in the swash plate to be rotatably coupled to a tip of the swash plate tilt support pin in a tilted manner, and a swash plate support means formed in the swash plate to support the drive shaft, wherein the swash plate has a through-hole larger than an outer diameter of the drive shaft, a guide rod is fixedly installed to the swash plate to cross the through-hole, the drive shaft has a guide hole through which the guide rod moves, and a spring as the swash plate support means is installed at the guide rod to be disposed between the drive shaft and the swash plate.

8. The assembly structure according to claim 7, wherein the guide hole is vertically formed at a projection extending from a side surface of the drive shaft.

9. The assembly structure according to claim 8, wherein two projections, two guide holes, and two guide rods are respectively formed about the drive shaft in an opposite manner.

10. The assembly structure according to claim 9, wherein the swash plate tilt support pin comprises a rod disposed in a radial direction thereof, and a cylindrical contact part formed to cross an end of the rod.

11. The assembly structure according to claim 10, wherein the rod has a shape that narrows away from the drive shaft.

12. The assembly structure according to claim 10, wherein the hinge coupling groove has an opening formed in the outer periphery of the swash plate, and a cap is installed at the opening.

13. The assembly structure according to claim 7, wherein a movable washer is interposed between the swash plate support means and the projection.

14. The assembly structure according to claim 13, wherein the swash plate support means is a coil spring or a disc spring.

15. The assembly structure according to claim 7, wherein the swash plate comprises an inner swash plate in which the through-hole and a guide rod are disposed, and an outer swash plate having a hinge coupling groove and coupled around the inner swash plate.

16. An assembly structure of a drive shaft and a swash plate in a swash plate type compressor comprising a housing, a cylinder block having a plurality of cylinder bores, a drive shaft rotatably supported by the cylinder block or the housing, a swash plate installed at the drive shaft to vary its tilt angle with respect to the drive shaft, and pistons reciprocally accommodated in the cylinder bores, characterized in that the assembly structure comprises:

a swash plate tilt support pin fixedly installed at the drive shaft to cross the drive shaft;

a hinge coupling groove formed in the swash plate to be rotatably coupled to a tip of the swash plate tilt support pin in a tilted manner, and a swash plate support means formed in the swash plate to support the drive shaft, wherein a stopper projects from a side surface of the drive shaft to limit rotation of the swash plate.

17. The assembly structure according to claim 16, wherein the swash plate tilt support pin comprises a rod disposed in a radial direction thereof, and a cylindrical contact part formed to cross an end of the rod.

18. The assembly structure according to claim 17, wherein the rod is detachably coupled to the contact part.

19. The assembly structure according to claim 17, wherein the rod has a shape that narrows away from the drive shaft.

20. The assembly structure according to claim 17, wherein the hinge coupling groove is opened at the outer periphery of the swash plate to form an opening, and a cap is installed at the opening.

21. The assembly structure according to claim 17, wherein the swash plate support means is a threshold projecting from an inner surface of the hinge coupling groove such that at least one end of the contact part in a circumferential direction of the swash plate is hooked.

22. The assembly structure according to claim 16, wherein the stoppers are formed at both surfaces of the drive shaft in an opposite manner.

23. The assembly according to claim 22, wherein a contact surface of a swash plate contact part of the stopper is in contact with a front surface of the swash plate upon a maximum tilt angle of the swash plate.

* * * * *